US009774113B2

(12) United States Patent
Zhang et al.

(10) Patent No.: US 9,774,113 B2
(45) Date of Patent: Sep. 26, 2017

(54) GROUNDING PLATE HAVING AN ARCUATE WALL WITH A SOLDERING NOTCH

(71) Applicant: FOXCONN INTERCONNECT TECHNOLOGY LIMITED, Grand Cayman (KY)

(72) Inventors: Xue-Liang Zhang, Kunshan (CN); Chien-Chiung Wang, New Taipei (TW); Kun-Lin Wu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/230,655

(22) Filed: Aug. 8, 2016

(65) Prior Publication Data

US 2017/0040746 A1 Feb. 9, 2017

(30) Foreign Application Priority Data

Aug. 7, 2015 (CN) ..... 2015 2 0590458 U

(51) Int. Cl.

| | |
|---|---|
| ***H01R 9/05*** | (2006.01) |
| ***H01R 12/59*** | (2011.01) |
| ***H01R 12/62*** | (2011.01) |
| ***H01R 13/6593*** | (2011.01) |
| ***H01R 13/6594*** | (2011.01) |
| *H01R 13/66* | (2006.01) |

(52) U.S. Cl.

CPC ..... *H01R 12/594* (2013.01); *H01R 12/62* (2013.01); *H01R 13/6593* (2013.01); *H01R 13/6594* (2013.01); *H01R 13/6658* (2013.01)

(58) Field of Classification Search

CPC ... H01R 13/6581; H01R 13/6471; H01R 9/05
USPC ..... 439/578
See application file for complete search history.

(56) References Cited

U.S. PATENT DOCUMENTS

| | | | | |
|---|---|---|---|---|
| 5,420,957 | A * | 5/1995 | Burek | G02B 6/4446 385/135 |
| 6,380,485 | B1 * | 4/2002 | Beaman | H01R 9/035 174/88 R |
| 7,267,575 | B1 * | 9/2007 | Hwang | H01R 9/034 439/497 |
| 7,435,132 | B1 * | 10/2008 | Fong | H01R 9/038 439/497 |
| 7,540,785 | B1 | 6/2009 | Zhao | |

(Continued)

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

A cable connector assembly includes: a shielding shell; an inner circuit board received in the shielding shell and defining a number of grounding pads; a cable electrically connecting to the inner circuit board, the cable including an outer boot, plural pairs of differential signal wires, and a number of grounding wires each corresponding to a respective pair of differential signal wires; and a grounding plate electrically connecting with the grounding pads; wherein the grounding plate includes a number of arcuate walls each having a respective receiving room accommodating a corresponding pair of differential signal wires, a notch is defined on a top of each of the arcuate walls, and the grounding wire is soldered in the notch.

16 Claims, 6 Drawing Sheets

(56) References Cited

U.S. PATENT DOCUMENTS

| | | | | |
|---|---|---|---|---|
| 8,267,718 | B2 * | 9/2012 | Straka | H01R 9/034 439/497 |
| 8,337,243 | B2 * | 12/2012 | Elkhatib | H01R 12/594 439/581 |
| 9,373,915 | B1 * | 6/2016 | Schulz | H01R 13/6594 |
| 2011/0306244 | A1 * | 12/2011 | Zhang | H01R 9/034 439/624 |
| 2012/0129396 | A1 * | 5/2012 | Wang | H01R 12/515 439/607.01 |
| 2012/0149255 | A1 * | 6/2012 | Wang | H01R 9/038 439/725 |
| 2014/0154921 | A1 * | 6/2014 | Qi | H01R 13/6581 439/620.03 |
| 2014/0220822 | A1 * | 8/2014 | Keyser | H01R 13/6592 439/607.46 |
| 2014/0322966 | A1 * | 10/2014 | Charette | H01R 13/506 439/578 |

* cited by examiner

GROUNDING PLATE HAVING AN ARCUATE WALL WITH A SOLDERING NOTCH

BACKGROUND OF THE INVENTION

1. Field of the Invention

The present invention relates to a cable connector assembly, especially to a structure of a grounding plate.

2. Description of Related Arts

U.S. Pat. No. 8,337,243, issued on Dec. 25, 2012, discloses a cable connector assembly including a shielding shell, an inner circuit board received in the shielding shell, a cable, and a grounding plate. The inner circuit board defines a number of grounding pads, the grounding plate electrically connecting with the grounding pads. The cable includes an outer boot, plural pairs of differential signal wires and plural grounding wires received in the outer boot. The grounding plate has a number of arcuated walls. Each of the arcuated walls has a receiving room for accommodating a corresponding pair of differential signal wires. The grounding wire is soldered with the grounding pad between two adjacent pairs of differential signal wires. The grounding plate further includes a number of soldering portions extending between two adjacent arcuated walls. The grounding wire is soldered in the soldering portion. The grounding wire is small in size such that it is difficult to solder the grounding wire to the soldering portion of the grounding plate.

An improved positional structure of the grounding pate is desired.

SUMMARY OF THE INVENTION

An object of the present invention is to provide a cable connector assembly including an arcuate wall defining a notch for soldering a grounding wire.

To achieve the above-mentioned object, a cable connector assembly includes: a shielding shell; an inner circuit board received in the shielding shell and defining a number of grounding pads; a cable electrically connecting to the inner circuit board, the cable including an outer boot, plural pairs of differential signal wires, and a number of grounding wires each corresponding to a respective pair of differential signal wires; and a grounding plate electrically connecting with the grounding pads; wherein the grounding plate includes a number of arcuate walls each having a respective receiving room accommodating a corresponding pair of differential signal wires, a notch is defined on a top of each of the arcuate walls, and the grounding wire is soldered in the notch.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
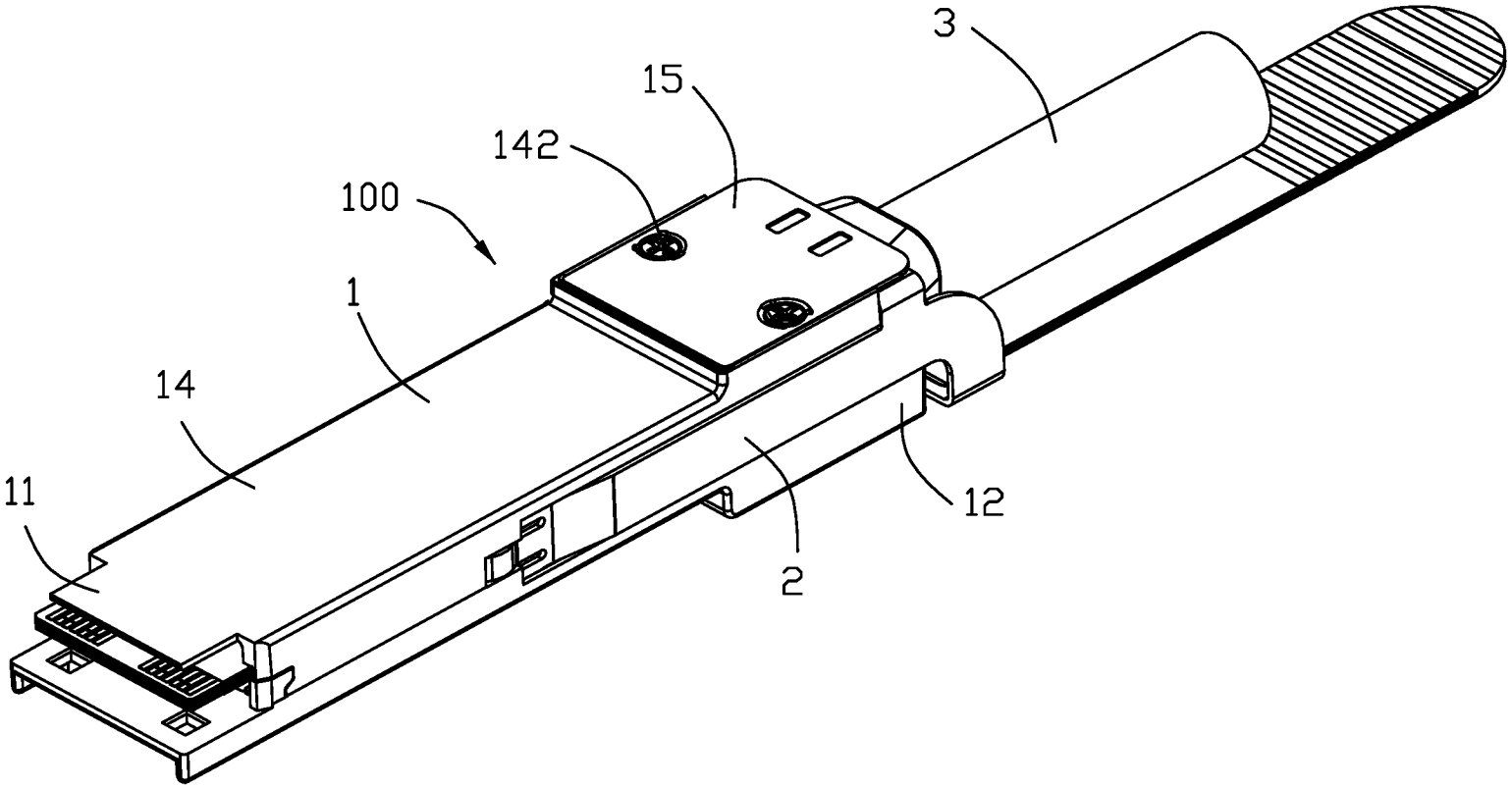
FIG. 1 is a perspective view of a cable connector assembly according to the present invention.
Figure 2:
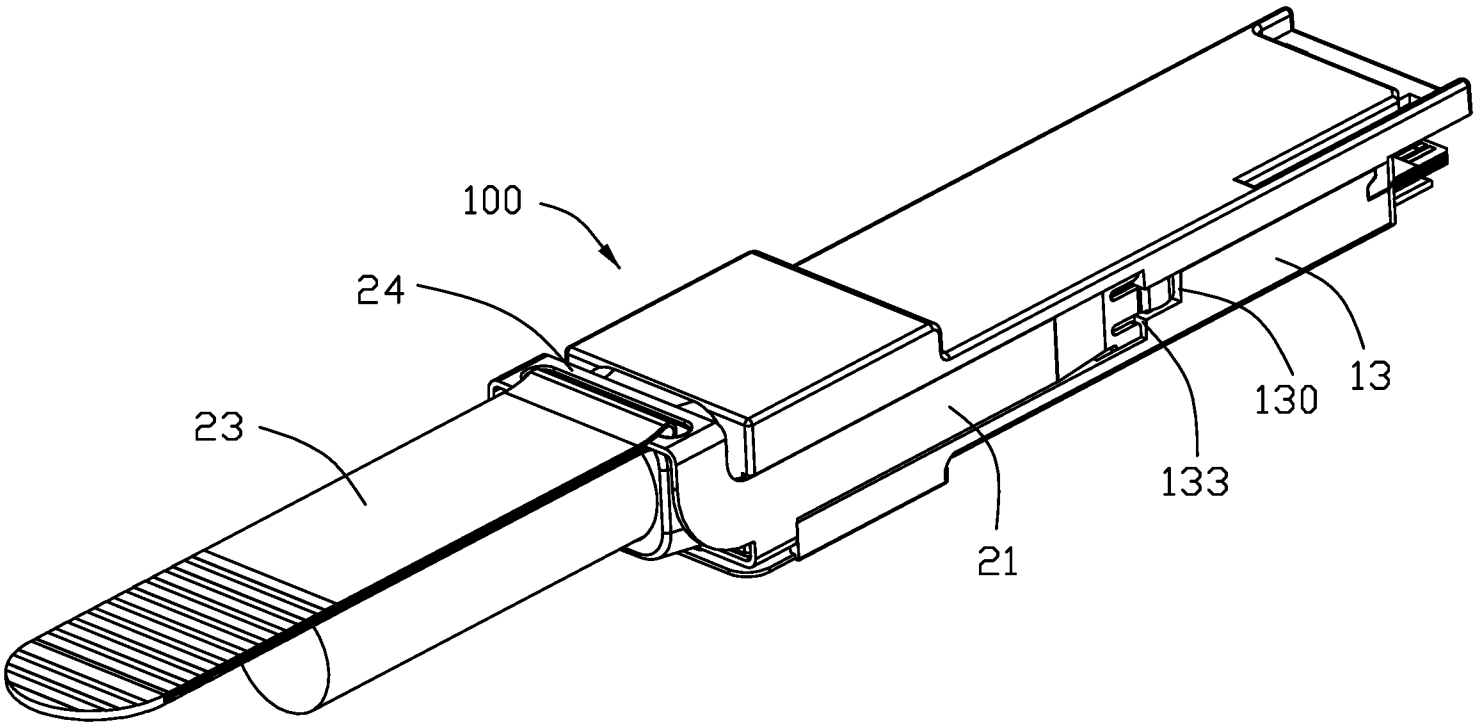
FIG. 2 is an another perspective view of a cable connector assembly as shown in FIG. 1.
Figure 3:
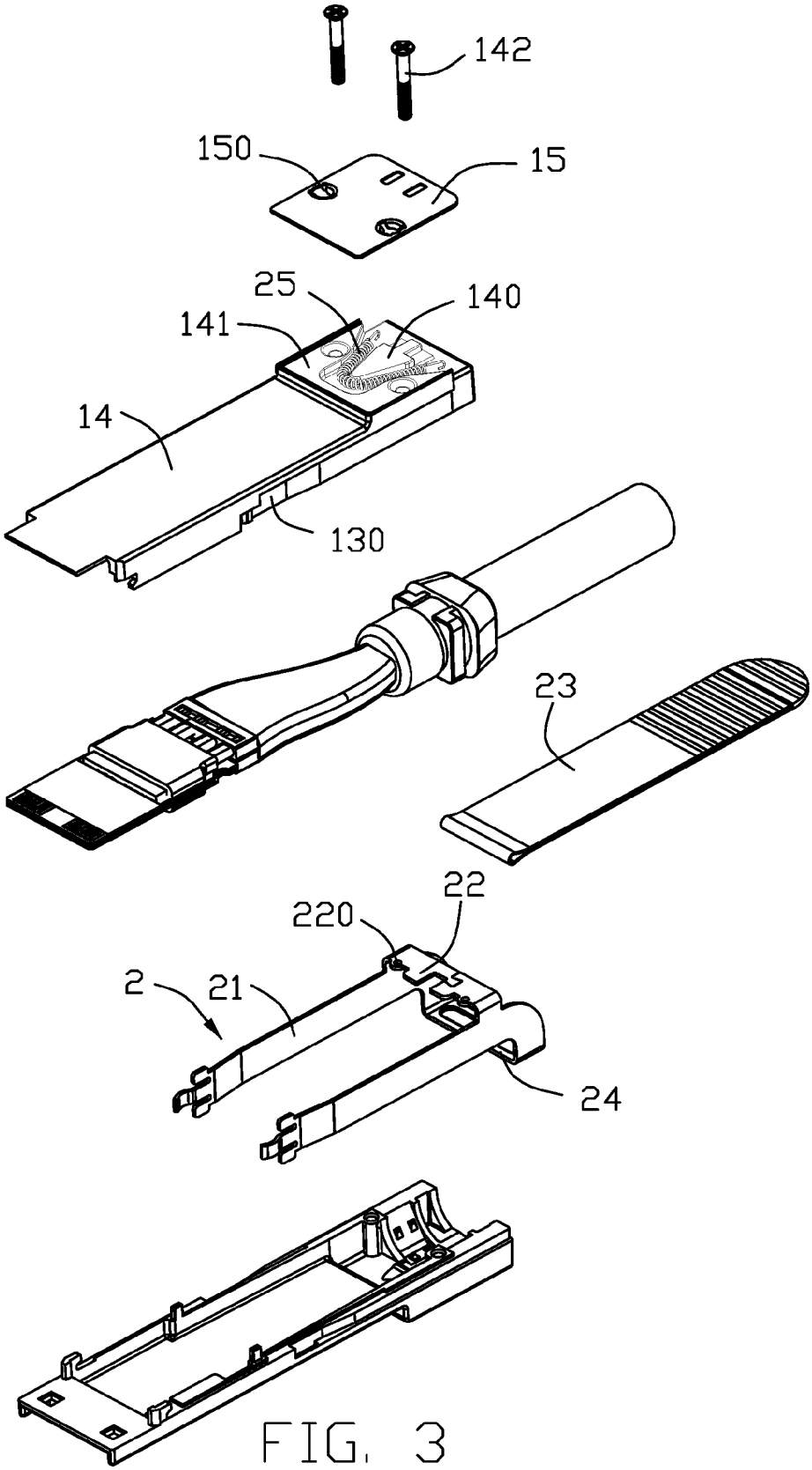
FIG. 3 is an exploded view of the cable connector assembly as shown in FIG. 1.

Referring to FIGS. 1-3, a cable connector assembly 100 can connect with a mating connector by a lock. The cable connector assembly 100 includes a shell 1 and a latch 2. The shell 1 has a front end 11 mating with the mating connector and a rear end 12 connecting with a cable 3.

The shell 1 has two side walls 13 opposite to each other and a top wall 14 between the two side walls 13. The latch 2 includes two driving arms 21 and a spring 25 contact to the driving arm 21. The driving arm 21 slides along a front-to-back direction on the two side walls 13. The side wall 13 defines a slit 130 for receiving the driving arm 21 and a step 133 perpendicular to a sliding direction in the front of the slit 130. An end of the driving arm 21 resists on the step 133.

The shell 1 defines a resisting portion 140 and a mounting portion 141 on the top wall 14. A slot 143 is form between the resisting portion 140 and a mounting portion 141 for receiving the spring 25. A protective cover 15 is mounted on the mounting portion 141. The protective cover 15 defines a mounting hole 150 and the shell 1 has a position part 142. The cover 15 is fixed on the top wall 14 of the shell 1 by the mounting hole 150 and the position part 142. The protective cover 15 covers the slot 143 to prevent the spring 25 to loose from the slot 143. When the driving arm 21 slides in an unlock position by an external force, the spring 25 is resisting on the resisting portion 140. When the external force is removed, the spring 25 leads the driving arm 21 back to the initial position by elastic restoring force of the spring 25.

The latch 2 further includes a first connecting portion 22 connecting the two driving arms 21, a second connecting portion 24 set under the first connecting portion 22, and a pull tab 23 fixed on the second connecting portion 24. The first connecting portion 22 and the second connecting portion 24 are integrative structure by stamping. The pull tab 23 twins around the second connecting portion 24 for providing a driving force to the driving arm 21. The first connecting portion 22 makes the two driving arms 21 to move together. The first connecting portion 22 defines two position holes 220 and two ends of the spring 25 interlock the position holes 220.

Figure 4:
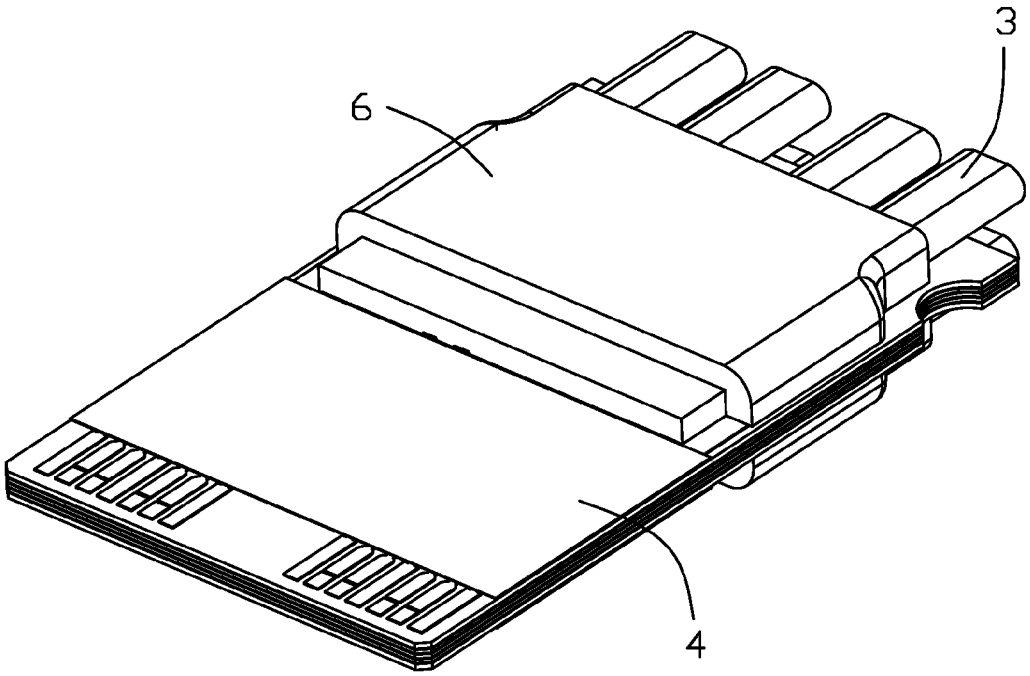
FIG. 4 is a perspective view of an insulative body enclosing a connecting portion of a cable soldered with an inner circuit board.
Figure 5:
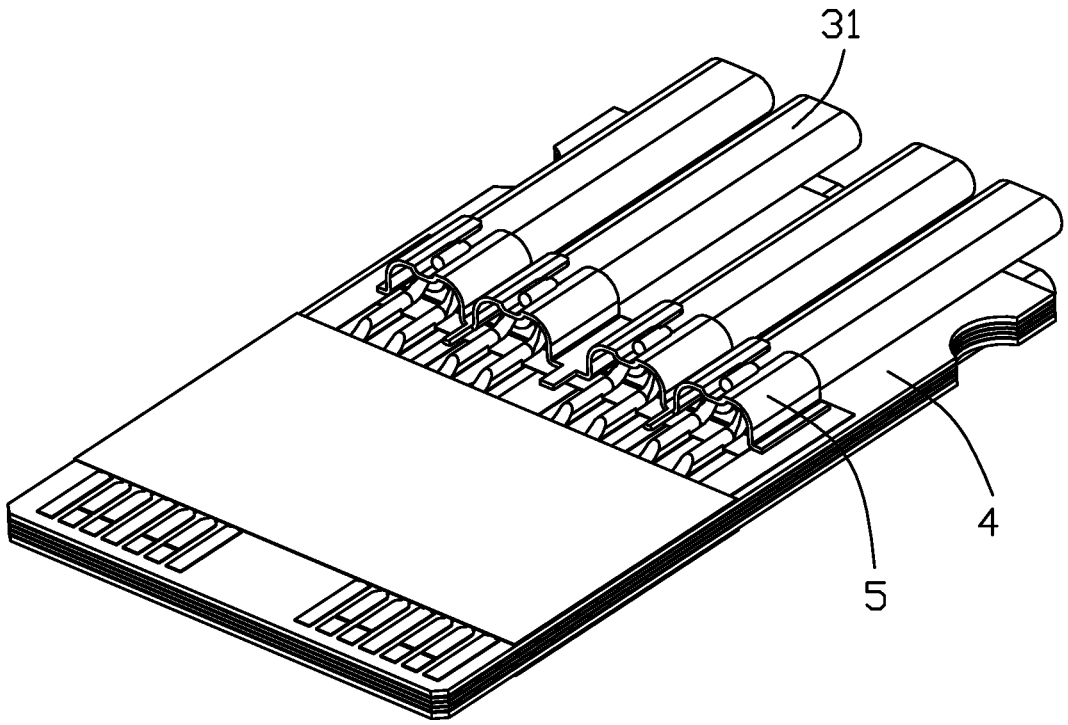
FIG. 5 is a perspective view of a grounding plate electrically connecting with an inner circuit board and a cable.
Figure 6:
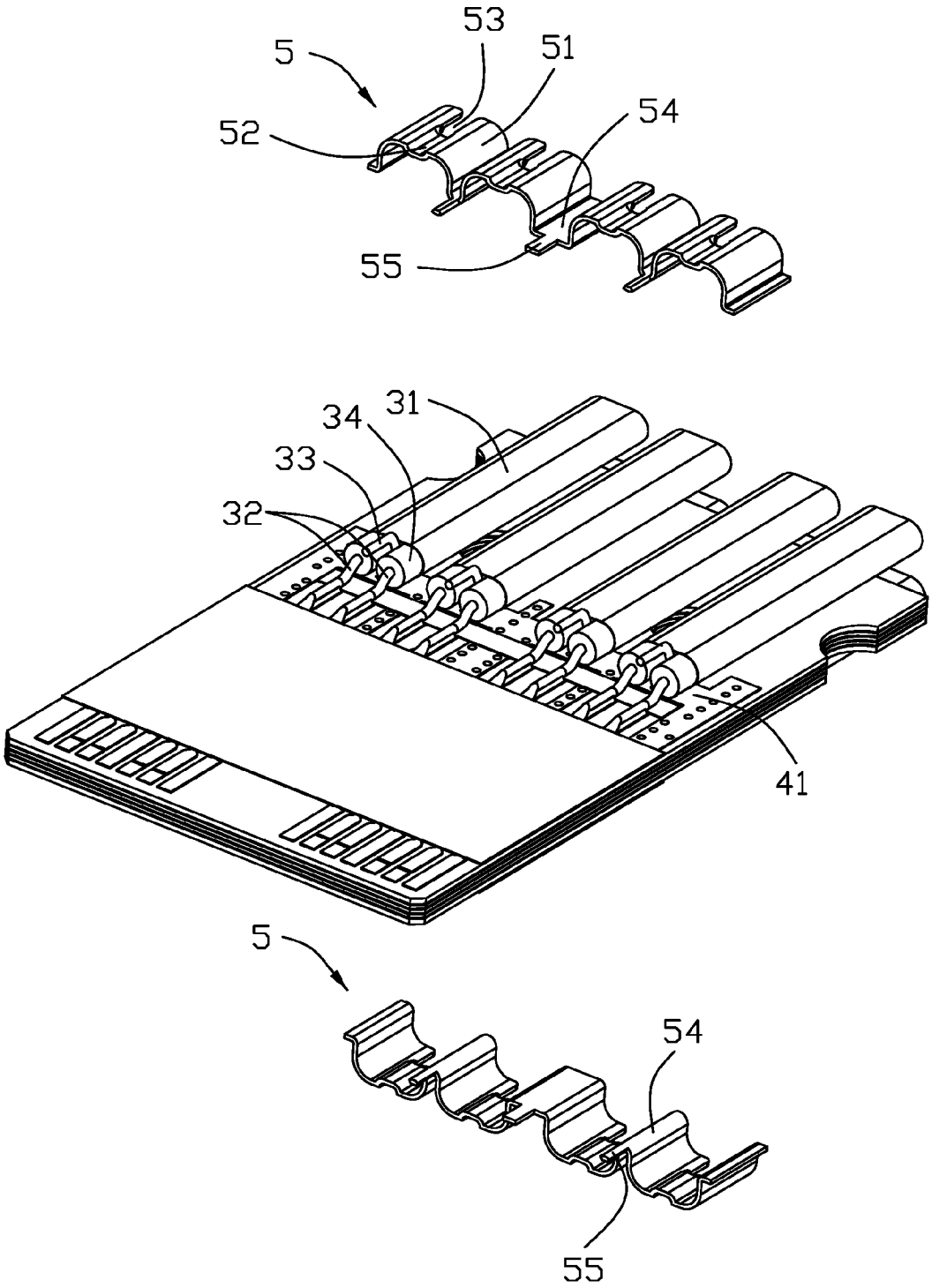
FIG. 6 is a perspective view of the grounding plate not mounted on the inner circuit board as shown in FIG. 5.

Referring to FIGS. 4-6, the cable connector assembly 100 further includes an inner circuit board 4 received in the shell 1, a grounding plate/bracket 5 electrically connecting with the inner circuit 4, and an insulative body 6 enclosed the inner circuit board 4. The inner circuit board 4 has an obverse and a reverse. Both of the obverse and the reverse are soldered with the cable 3 and the grounding plate 5. The insulative body 6 encloses the soldering portion of the inner circuit board 4, the grounding plate 5 and the cable 3. The cable 3 includes an outer boot 31, a number of pairs of differential signal wires 32 and grounding wires 33. One grounding wire 33 is corresponding to one pair of differential signal wires 32. A pair of differential signal wires 33 transmits a positive signal and a negative signal. The grounding wire 33 is over and between the two differential signal wires 33. The positive signal and the negative signal are symmetrically arranged relative to the grounding wire 33. When the positive signal and the negative signal are transmitting, the grounding wire 33 has same shielding effects on the positive signal and the negative signal. Therefore, the loss of the signal reduces in the transmitting process.

Each of differential signal wires 32 is enclosed a braided layer 34 for shielding. The grounding plate 5 has a number of connected arcuated (receiving) walls 51. Each of arcuated walls 51 forms a receiving room for receiving a pair of differential signal wires. The differential signal wires 32 are insulated with the arcuated wall 51. The arcuated wall 51 has a notch 52 and a cutout 53 connecting with the notch 52 on the top wall. The notch 52 and the cutout 53 are in the middle of the top wall. The cutout 53 runs through the top wall. The grounding wire 33 runs through the cutout 53 and solders in the notch 52 electrically connecting with the arcuated wall 51. The grounding plate 5 has four arcuated wall 51, a connecting portion 54 between two adjacent arcuated walls 51, and a soldering portion 55 forward extending from the connecting portion 54. A first distance of two middle arcuated walls 51 is larger than the second distance of the other two adjacent arcuated walls 51. The inner circuit board 4 has a number of grounding pads 41, the soldering portion 55 of the grounding plate 5 is soldered on the grounding pad 41. The braided layer 34 also is soldered on the grounding pad 41.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A cable connector assembly comprising:

a printed circuit board defining a plurality of signal pads and grounding pads alternately arranged with each other along a transverse direction;

a cable electrically and mechanically connected to the inner circuit board, the cable comprising plural pairs of differential signal wires soldered upon the corresponding signal pads, respectively, and a plurality of grounding wires each corresponding to a respective pair of differential signal wires; and a grounding bracket mechanically and electrically connected to the grounding pads and including a plurality of connecting portions and a plurality of arcuate walls alternately arrange with said soldering portions in said transverse direction, each of the connecting portions seated upon the printed circuit board and each of said arcuate walls having a respective receiving room accommodating a corresponding pair of differential signal wires; wherein a plurality of grounding wires have corresponding exposed front end sections extending forwardly in a front-to-back direction perpendicular to said transverse direction, and soldered upon the corresponding arcuate walls, respectively, so that the exposed front end sections of said grounding wires and those of the corresponding signal wires are spaced and separated from each other by the corresponding arcuate walls in a vertical direction perpendicular to both said transverse direction and said front-to-back direction.

2. The cable connector assembly as claimed in claim 1, wherein the exposed front end section of each of said grounding wires is essentially located between the corresponding signal wires of the same pair in an isosceles manner.

3. The cable connector assembly as claimed in claim 2, wherein each of said arcuate walls forms a cutout to receive the exposed front end section of the corresponding grounding wire.

4. The cable connector assembly as claimed in claim 3, wherein each of said arcuate walls forms a notch toward the printed circuit board in the vertical direction to receive the exposed front end section of the corresponding grounding wire.

5. The cable connector assembly as claimed in claim 4, wherein said notch is aligned with the corresponding cutout in said front-to-back direction.

6. The cable connector assembly as claimed in claim 5, wherein said cutout is located behind the corresponding notch in said front-to-back direction.

7. The cable connector assembly as claimed in claim 5, wherein said cutout has a similar dimension with the corresponding notch in the transverse direction.

8. The cable connector assembly as claimed in claim 4, wherein said exposed front end section is soldered in the corresponding notch.

9. The cable connector assembly as claimed in claim 1, wherein the exposed front end sections of each of the grounding wires and the exposed front end sections of the corresponding signal wires are terminated at different axial positions of the corresponding cable, and wherein the axial position where the exposed front end section of the grounding wire is terminated, is located behind another axial position where those of the exposed front end sections of the corresponding signal wires of the same pair are terminated.

10. The cable connector assembly as claimed in claim 1, wherein each of said arcuate walls forms a notch bulged toward the printed circuit board in the vertical direction to receive the exposed front end section of the corresponding grounding wire, and said notch extends in said front-to-back direction.

11. A cable connector assembly comprising:

a printed circuit board defining a plurality of signal pads and grounding pads alternately arranged with each other along a transverse direction;

a cable electrically and mechanically connected to the inner circuit board, the cable comprising plural pairs of differential signal wires soldered upon the corresponding signal pads, respectively, and a plurality of grounding wires each corresponding to a respective pair of differential signal wires; and a grounding bracket mechanically and electrically connected to the grounding pads and including a plurality of connecting portions and a plurality of receiving walls alternately arrange with said soldering portions in said transverse direction, each of the connecting portions soldered upon the printed circuit board and each of said receiving walls having a respective receiving room accommodating a corresponding pair of differential signal wires; wherein a plurality of grounding wires have corresponding exposed front end sections mechanically and electrically connected to the corresponding receiving walls, respectively, so that said grounding wires and the corresponding signal wires are elevated from the printed circuit board and spaced and separated from the corresponding signal wires by the corresponding receiving wall in a vertical direction perpendicular to said transverse direction; wherein each of said receiving walls forms a notch to stably receive the corresponding grounding wire along a front-to-back direction perpendicular to both said transverse direction and said vertical direction; wherein each of said receiving walls forms a cutout out communicating with the corresponding notch to allow the exposed front end section of the corresponding grounding wire to extend therethrough in the vertical direction and into the corresponding notch.

12. The cable connector assembly as claimed in claim 11, wherein the cutouts is aligned with and located behind the corresponding notches, respectively, in said front-to-back direction, and the cutout is dimensioned similar to the corresponding notch in the transverse direction.

13. The cable connector assembly as claimed in claim 11, wherein the exposed front end section is soldered in the corresponding notch.

14. The cable connector assembly as claimed in claim 11, wherein the exposed front end section of each of the grounding wires extends forwardly to be received in the corresponding notch.

15. The cable connector assembly as claimed in claim 14, wherein the exposed front end sections of each of the grounding wires and the exposed front end sections of the corresponding signal wires are terminated at different axial positions of the corresponding cable, and wherein the axial position where the exposed front end section of the grounding wire is terminated, is located behind another axial position where those of the exposed front end sections of the corresponding signal wires of the same pair are terminated.

16. The cable connector assembly as claimed in claim 14, wherein the exposed front end section of each of the grounding wires is soldered in the corresponding notch.

* * * * *